US006176000B1

(12) United States Patent
Lulay et al.

(10) Patent No.: US 6,176,000 B1
(45) Date of Patent: Jan. 23, 2001

(54) LOW VOLTAGE ELECTROMAGNETIC PROCESS FOR CONTROLLED RIVETING

(75) Inventors: Kenneth E. Lulay, Seattle; Paul G. Kostenick, Everett, both of WA (US)

(73) Assignee: The Boeing Company, Seattle, WA (US)

( * ) Notice: Under 35 U.S.C. 154(b), the term of this patent shall be extended for 0 days.

(21) Appl. No.: 09/439,757

(22) Filed: Nov. 15, 1999

Related U.S. Application Data

(62) Division of application No. 09/096,884, filed on Jun. 12, 1998, now Pat. No. 6,014,804.

(51) Int. Cl.[7] ..... B23Q 17/00; G01M 19/00

(52) U.S. Cl. ..... 29/407.05; 29/522.1; 29/524.1; 29/525.06; 29/715

(58) Field of Search ..... 29/715, 243.517, 29/243.53, 407.08, 524.1, 407.01, 407.05, 509, 522.1, 525.05, 525.06; 227/2, 11

(56) References Cited

U.S. PATENT DOCUMENTS

| | | | | |
|---|---|---|---|---|
| 4,862,043 | * | 8/1989 | Zieve | 318/114 |
| 5,471,865 | * | 12/1995 | Michalewski et al. | 29/243.53 |
| 5,575,166 | * | 11/1996 | Michalewski et al. | 29/243.53 |
| 5,752,306 | * | 5/1998 | Clark et al. | 29/524.1 |
| 5,813,110 | * | 9/1998 | Arnston et al. | 29/243.53 |

* cited by examiner

*Primary Examiner*—S. Thomas Hughes
*Assistant Examiner*—Jermie E. Cozart
(74) *Attorney, Agent, or Firm*—Lawrence W. Nelson

(57) ABSTRACT

The present invention relates to a method for minimizing undesirable gaps in riveted assemblies. The method includes the steps of selecting a rivet having a head and a tail with identical forming characteristics, positioning the selected rivet in an assembly that is countersunk on one of two sides, and applying a force over time to the head of the rivet and a force over time to the tail of the rivet that are equal and opposite, compensating for force unbalancing characteristics of the countersink.

3 Claims, 7 Drawing Sheets

LOW VOLTAGE ELECTROMAGNETIC PROCESS FOR CONTROLLED RIVETING

This is a divisional of application Ser. No. 09/096,884, filed on Jun. 12, 1998 now U.S. Pat. No. 6,014,804.

BACKGROUND OF THE INVENTION

1. Field of the Invention

The present invention relates to a low-voltage electromagnetic riveting apparatus and method, and more particularly to a method and apparatus for controlled and efficient low-voltage electromagnetic riveting.

2. Background Information

Riveting machines are well known and in wide use throughout the aerospace industry, as well as in other industries. Rivets provide the best known technique for fastening an aerodynamic skin to a frame to provide a strong, aerodynamically smooth surface. Rivets are also used in the interior structure of an aircraft, since they are the lightest and least expensive way of fastening structural components together.

One form of riveting uses a low voltage electromagnetic riveting (LVEMR) system 100, as shown in FIG. 1. The LVEMR system 100 provides a controlled amount of energy in a single pulse and is typically smaller and less cumbersome than a pneumatic or hydraulic system. Further, the LVEMR system has almost no mass so it only has nominal reactionary forces. The LVEMR system 100 shown in FIG. 1 incorporates two electromagnetic actuators, a first actuator 101 and a second actuator 112, which are positioned on opposite sides of first and second workpieces 114 and 115, respectively. The first and second work pieces 114 and 115 are sandwiched together and a hole has been drilled through them to accommodate a rivet 93. The first and second actuators 101 and 112 each include a body 116 in which is positioned a driver 118 and a coil 120. A rivet die 92 is coupled to the driver 118 and is forced against the rivet 93. Also, there may be a recoil mass 123 which is typically secured to a rear surface of the coil 120. Extending from the recoil mass 123 is an air cylinder rod 124, which extends out of the body 116 into a two-chamber air cylinder 126. Associated pressure relief valves and other control elements are shown diagramatically as block 128. The elements of block 128 are responsible for initially positioning the driver 118 and its rivet die 92 against a head of the rivet 93.

Power is supplied to the system 100 by means of a power supply 130. A DC output from the supply 130 is used to charge a bank of capacitors in circuit 132 to a selected voltage. The voltage selected is based on the force necessary to accomplish the desired riveting task. The circuit 132 includes an electronic switch positioned between the capacitors and the coil 120.

A trigger signal from a firing circuit 134 activates the electronic switch, dumping the charge of the capacitor bank in circuit 132 into the coil 120. A current pulse is induced into the coil 120 causing strong eddy currents in a copper plate 119 located at the base of the driver 118. This creates a very strong magnetic field that provides a repulsive force relative to the coil 120. The driver 118 is propelled forward with a large force causing the rivet die 92 to upset the head of the rivet 93. A more detailed discussion of low voltage electromagnetic riveting can be found in U.S. Pat. No. 4,862,043, which is incorporated herein by reference.

Once the LVEMR system 100 has upset the rivet 93, a fastened assembly 140 is created as shown in FIG. 1B. The assembly 140 includes a deformed rivet 146, having a head 142 and a tail 154. The hole drilled into the first and second workpieces 114 and 115 includes a countersink 148 drilled into the second workpiece 115 to receive the head 142 of the deformed rivet 146.

Unfortunately, the fastened assembly 140, when produced by the LVEMR system 100 described above, has significant gaps 150 between the head 142 of the deformed rivet 146 and the countersink 148. The gaps 150 are undesirable since they could lead to early corrosion of the deformed rivet 146, causing it to weaken and prematurely fail. Accordingly, for the foregoing reasons, there is a need in the art for a controlled low-voltage electromagnetic riveting apparatus and process that mitigates the gaps 150 between the rivet head 142 and the countersink 148.

SUMMARY OF THE INVENTION

In one aspect, the present invention is directed to a method for minimizing undesirable gaps in riveted assemblies including the steps of selecting a rivet having a head and a tail with identical forming characteristics, positioning the selected rivet in an assembly that is countersunk on one of two sides, and applying a force over time to tile head of the rivet and a force over time to the tail of the rivet that are equal and opposite, compensating for force-unbalancing characteristics of the countersink.

In another aspect, the present invention is directed to a method for mitigating gaps between a deformed head of a rivet and a countersink in an assembly that is coupled by a low-voltage electromagnetic riveter having a head side actuator and tail side actuator. The method includes the steps of selecting a rivet that uniformly deforms at a tail and at a head of the rivet, positioning the volume of the rivet within the assembly such that force applied over time to the head of the rivet by the head side actuator equals a force applied over time to the tail of the rivet by the tail-side actuator.

In yet another aspect, the present invention is directed to a method for mitigating gaps between a head of a rivet and a countersink within a first workpiece of two workpieces when the rivet is upset by a low voltage electromagnetic riveting process. The method includes the steps of extending a tail of the rivet out of a surface of a second workpiece of the two workpieces by a length from 0.9 to 1⅓ times a diameter of the rivet, extending the head of the rivet out of a base of the countersink by a length that is 5% to 10% less than the length the tail of the rivet was extended out of the second workpiece surface, and upsetting the tail of the rivet with a tail die having a shape substantially similar to a shape of the countersink within the first workpiece.

In still another aspect, the present invention is directed to a method for controlled low-voltage electromagnetic riveting of a primary workpiece including a countersink and at least a secondary workpiece with a rivet, having a head, a tail, and a diameter, using a head actuator having a head die to contract the head of the rivet and a tail actuator having a tail die to contact the tail of the rivet. The method includes the steps of selecting the rivet so the rivet is comprised of a homogenous alloy and the rivet has a uniform diameter, positioning the tail of the rivet so that it protrudes from an outside surface of the secondary workpiece by a length from 1 to 1.3 times the diameter of the rivet, positioning the head of the rivet so that it protrudes from the base of the countersink by a length that is 5 to 10 percent less than the length that the tail protrudes from the step of positioning the tail, upsetting the head of the rivet with the head die having a flat contact surface, and upsetting the tail of the rivet with the tail die, wherein the tail die has an upper diameter within 20% of the depth of the countersink, and wherein the tail die has an upper diameter within 10 degrees of the upper angle of the countersink.

In another aspect, the present invention is directed to a low-voltage electromagnetic riveter for controlling the force over time applied to a head and a tail of a rivet within an assembly having a workpiece that is countersunk to receive the head of the rivet. The riveter includes a head and a tail actuator that respectively apply a force over time to the head and the tail of the rivet. Each of the actuators includes a die which contacts the rivet, a coil which creates a repulsive force when electrical current is passed therethrough, a driver physically adjacent to the coil and movable along an axis of the rivet by the repulsive force created by the coil, and a load cell positioned between the driver and the die to measure the force over time applied to a designated end of the rivet. A head current source and a tail current source are electrically connected to the coil of the respective head and tail actuator for supplying a controlled amount of current, and a firing circuit is electrically connected to each of the head current source and the tail current source for controlling phase and magnitude of the controlled amount of current supplied to each of the head actuator and the tail actuator.

In yet another aspect, the present invention is directed to a method for controlled low-voltage electromagnetic riveting. The method includes the steps of monitoring the force applied over time to a head and tail of a rivet during a deformation of the rivet by the low-voltage electromagnetic riveting, adjusting a phase of the force applied to at least one of a location of the head and the tail of the rivet so that the phase of the force applied to the location of the head of the rivet equals the phase of the force applied to the location of the tail of the rivet, and adjusting a magnitude of the force applied to at least one of the location of the head and the tail of the rivet so that the magnitude of the force applied to the location of the rivet head equals the force applied to the location of the tail of the rivet.

In still another aspect, the present invention is directed to a method for mitigating gaps between a deformed head of a rivet and a countersink in an assembly that is coupled by a low-voltage electromagnetic riveter, including a head-side driver, having a first load cell, and a tail side driver, having a second load cell, and a firing control circuit capable of controlling phase and magnitude of force applied by the head-side driver and the tail-side driver. The method includes the steps of positioning a first test rivet within the assembly, monitoring a first output of the first load cell and the second load cell while the first test rivet is upset to determine the phase and the magnitude of the force applied to a head and a tail of the rivet respectively by the head side driver and the tail side driver, comparing the first output of the first load cell and the second load cell that occurred when the first test rivet was upset, and adjusting the phase of one of the force applied by the head driver and the force applied by the tail driver so that the phase of the force applied by the head driver matches the phase of the force applied by the tail driver. The method also includes the steps of positioning a second test rivet within the assembly, monitoring a second output of the first load cell and the second load cell while the second test rivet is upset to determine the phase and the magnitude of the force applied to the head and the tail of the second test rivet respectively by the head side driver and the tail side driver, comparing the second output of the first load cell and the second load cell that occurred when the second test rivet was upset, and adjusting the magnitude of one of the force applied by the head driver and the force applied by the tail driver so that the magnitude of the force applied by the tail driver equals the magnitude of the force applied by the head driver.

BRIEF DESCRIPTION OF THE DRAWINGS

These and other features, aspects, and advantages of the present invention will be better understood with regard to the following description, appended claims, and accompanying drawings wherein:

DETAILED DESCRIPTION OF THE PREFERRED EMBODIMENTS

The following process and apparatus assist in controlling and balancing the forces applied to a rivet. Such control mitigates gaps between a head of a rivet and a countersink into which it is deformed. Other advantages include more accurate control over rivet interferences and a reduction in reactive forces applied to an object being riveted.

It has been discovered that to mitigate the gaps between the rivet and the countersink, it is essential to maintain an equal force on the head and a tail of the rivet throughout the riveting process. Unfortunately, when the workpiece or assembly to be riveted has been countersunk to receive a deformed rivet head, simultaneous activation of two opposing LVEMR guns will not produce equal forces on the rivet head and the rivet tail over the duration of time that the rivet is deformed.

Figure 2:
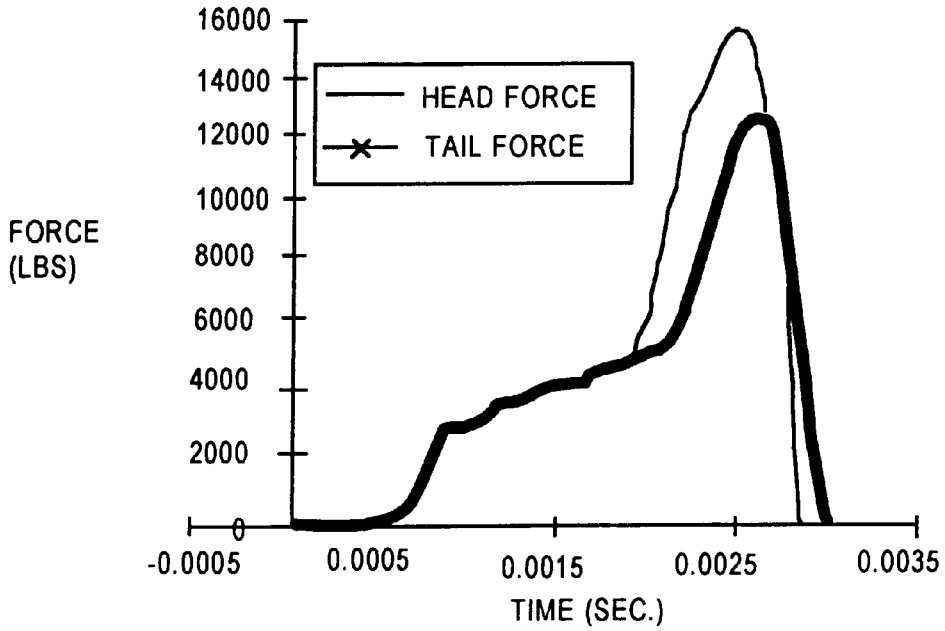
FIG. 2 PRIOR ART
FIG. 2 shows a force vs. time graph applied to a rivet during its deformation into a hole having a countersink.
Figure 3:
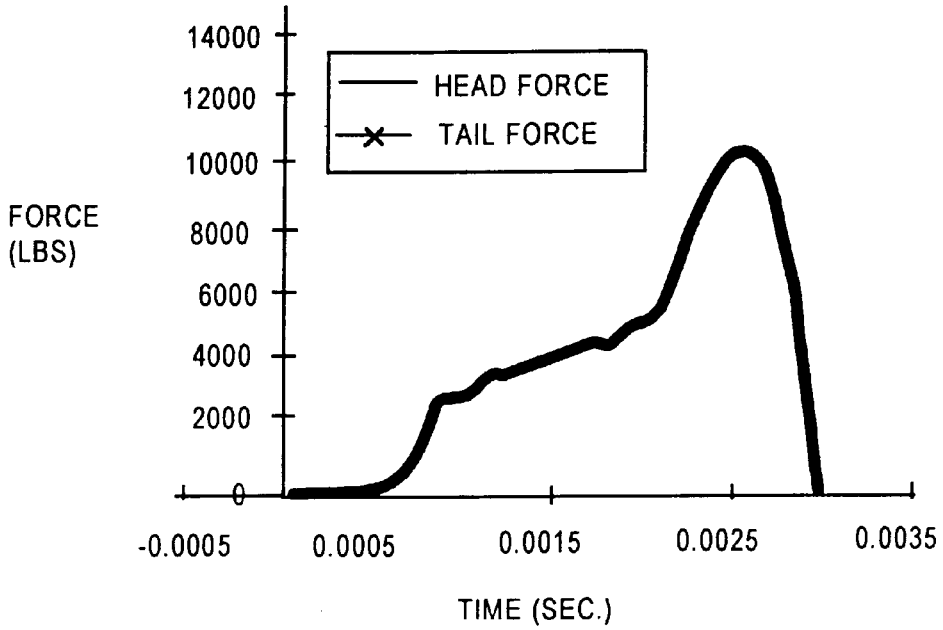
FIG. 3 shows a force vs. time graph applied to a rivet using a process and apparatus for mitigating gaps according to the present invention.

Low voltage electromagnetic rivet (LVEMR) guns are typically dynamic and used in an open loop system, as such, they offer no method of "real-time" force control during the rivet-forming process. Because the LVEMR guns are used in an open loop, they produce a dissimilar force on the head and tail over time, as shown in FIG. 2. However, the forming process can be manipulated to compensate for the force unbalancing effects of a countersink within a workpiece. This manipulation is accomplished by selecting process variables so that the head and tail of the rivet have similar forming characteristics over time as shown in FIG. 3.

Figure 1A:
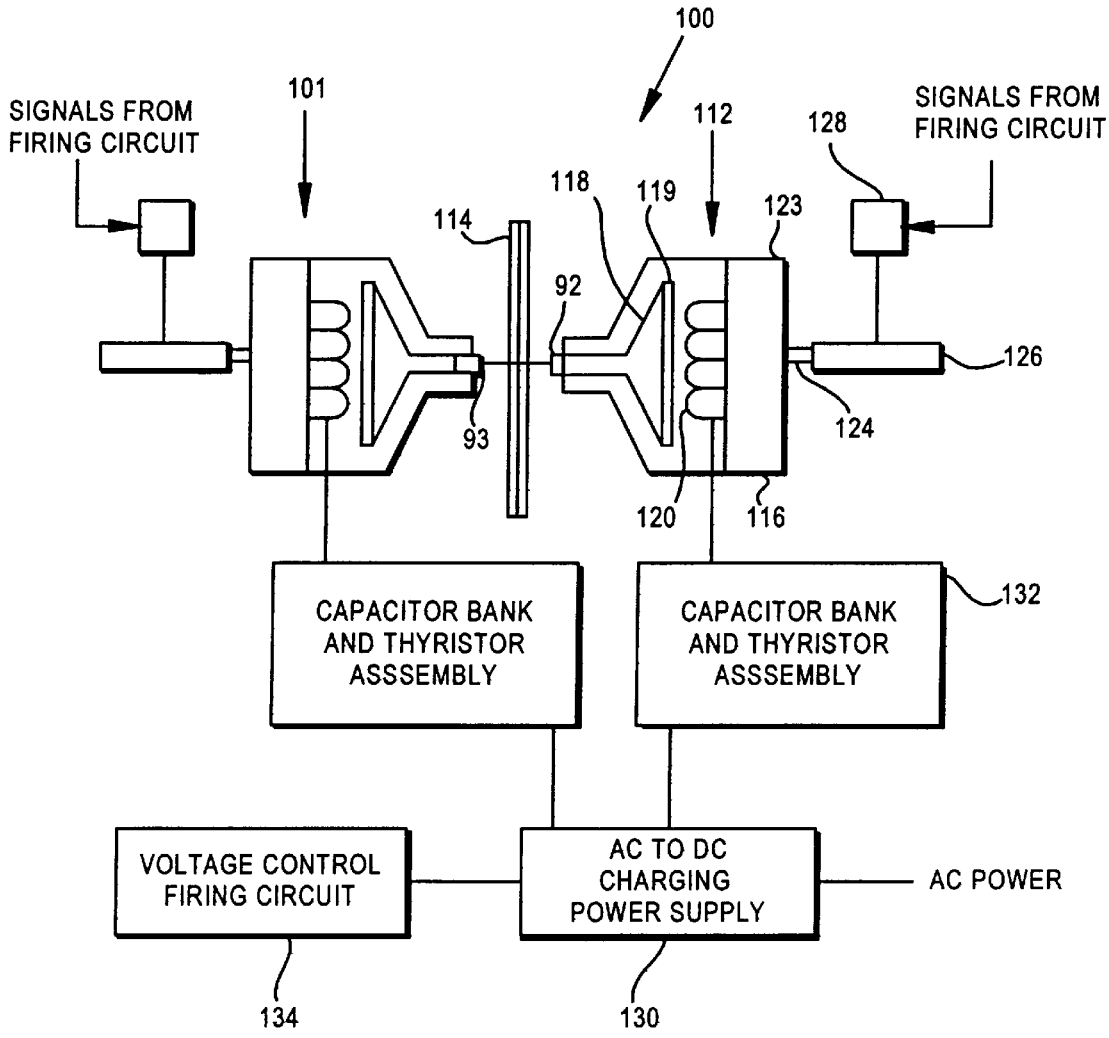
FIG. 1A PRIOR ART
FIG. 1A shows a block diagram of a prior art low-voltage electromagnetic riveting system.
Figure 1B:
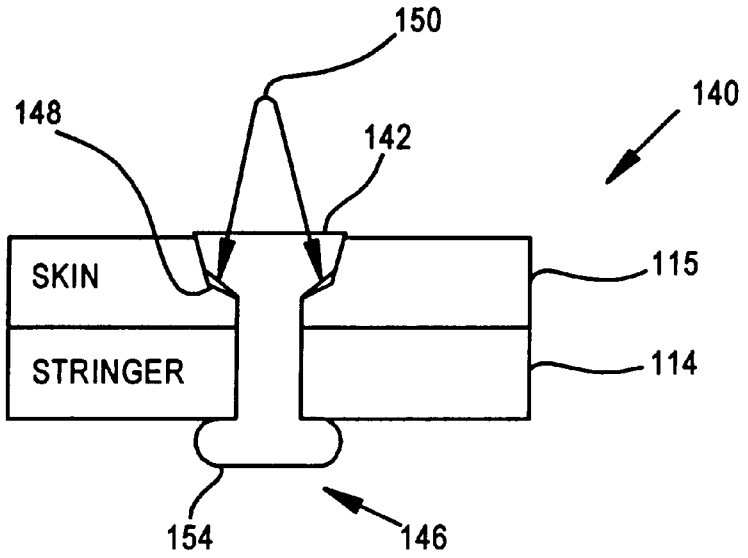
FIG. 1B PRIOR ART
FIG. 1B shows a rivet deformed by the riveting system of FIG. 1A.
Figure 4:
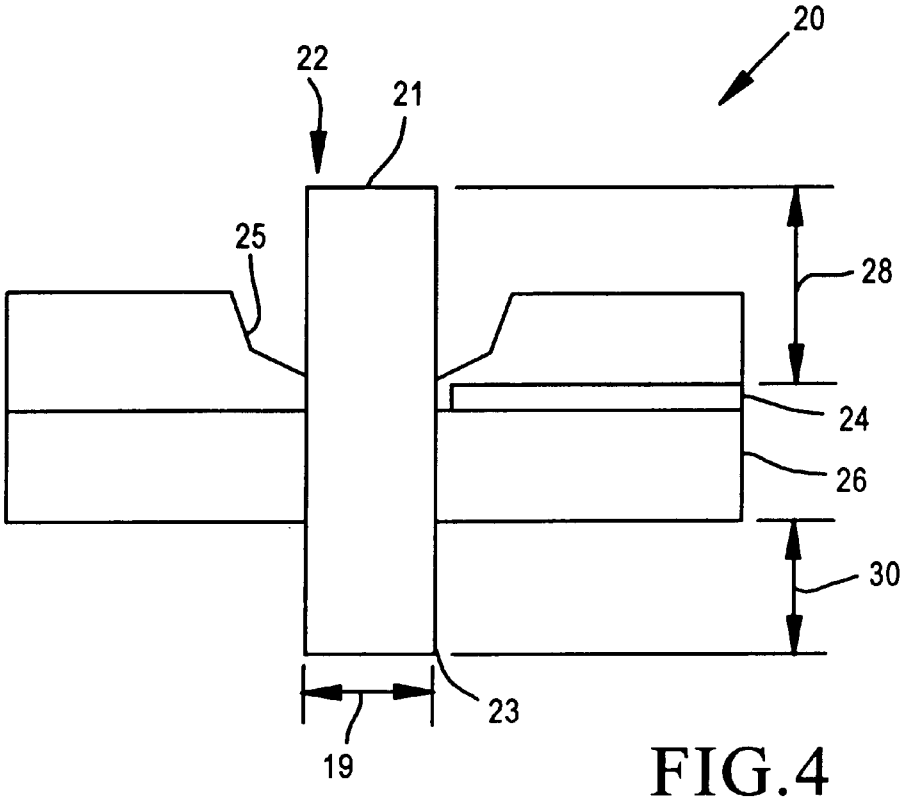
FIG. 4 shows a desired rivet protrusion to mitigate gaps according to a first embodiment of the present invention.
Figure 5:
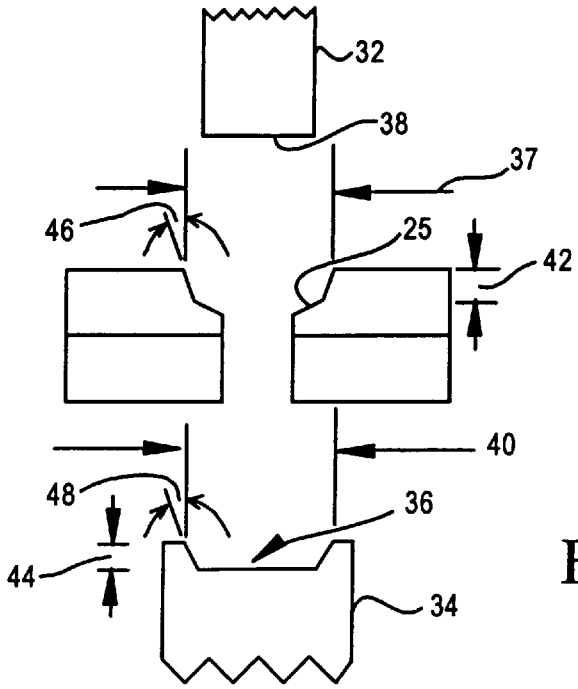
FIG. 5 shows a desired forming die configuration according to the first embodiment of the present invention.

In a first embodiment, as shown in FIGS. 4 and 5, the force-displacement relationship of a head 21 and tail 23 of a rivet 22 are manipulated via the forming characteristics of the rivet 22 to maintain a force balance between the head 21 and the tail 22.

Five factors typically affect the forming characteristics of the rivet 22, and therefore can be used to affect the force-displacement relationship of the head 21 and the tail 23. First, there is the mechanical properties of the rivet 22, i.e. the stress—strain relation. Since rivets are typically composed of a homogenous alloy, there is no difference in the material adjacent the head 21 and the tail 23. Therefore, this factor does not create a difference in the force-displacement between the head 21 and the tail 23. Second, the diameter of the rivet will affect the force-displacement along the rivet 22. Any difference in force-displacement due to diameter effects between the head 21 and the tail 23 can be eliminated by using a slug rivet, which has a constant diameter throughout.

The third factor affecting the force-displacement relationship of the rivet 22 is the amount of rivet 22 that extends out of the primary sheet 24 and the secondary sheet 26. This includes a head protrusion 28 of the rivet 22 above a countersink 25 in the primary sheet 24 to be coupled to the secondary sheet 26, as shown in FIG. 4. The third factor also includes a tail protrusion 30 from the secondary sheet 26. The larger the protrusion values for the head protrusion 28 and the tail protrusion 30, the more the displacement of the protrusion for a given force, i.e., a soft force-displacement relationship.

The fourth factor affecting the force-displacement is the geometry of the countersink 25, and the fifth factor is the design of a head die 32 and a tail die 34 used to upset the rivet 22, as shown in FIGS. 4 and 5. Captivating dies, such as the tail die 34, and deep countersinks, such as the countersink 25, create a stiffer force-displacement relationship. Therefore, there is less displacement of the rivet 22 for a given force when using dies, such as the tail die 34, and countersinks, such as countersink 25, that prevent the material of the rivet 22 from flowing outward when it is upset.

In the first embodiment, a preferred combination of the above-described factors maintains a balanced force, i.e. equal force on the tail 21 the head 23, throughout the riveting process which results in the elimination of any gaps between the deformed head and the countersink 25. Referring to FIG. 4, the preferred combination has the amount of head protrusion 28 at a length that is five to ten percent less than the length of the tail protrusion 30. In other words:

$$\text{Head Protrusion}=(1-[0.05 \text{ to } 0.10])\ (\text{Tail Protrusion}).$$

Further, referring to FIG. 4, the tail protrusion 30 is preferably 0.9 to 1.3 times a diameter 19 of the rivet 22. In other words:

$$\text{Tail Protrusion}=[0.9 \text{ to } 1.3]\ \text{Rivet Diameter}.$$

Referring to FIG. 5, the depth 44 of a contact surface 36 of the tool die 34 in the preferred combination must be similar to, i.e. within 20% of, the depth 42 of the countersink 25. The contact surface 38 of the head die 32 is preferably flat. Also, an upper diameter 40 of the tail die 34 must be similar to a countersink diameter 37, i.e. the upper diameter 40 must be within 20% of the countersink diameter 37. Finally, an upper angle or taper 48 of the edge of the die surface of the tail die 34 must be similar, i.e. to an upper angle or taper 46 of the countersink, i.e. within 20%.

Figure 6B:
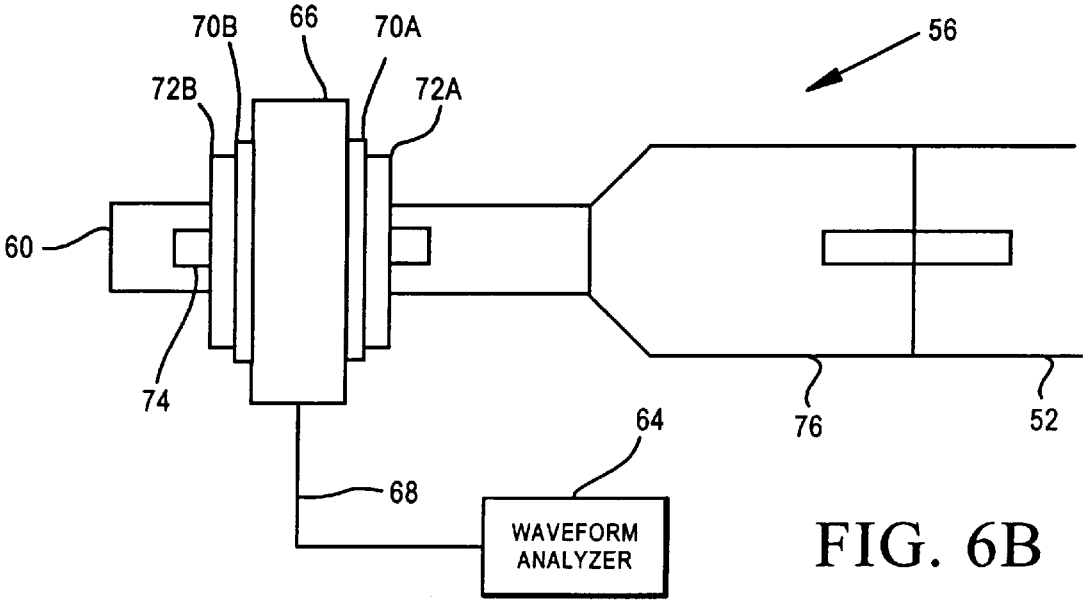
FIG. 6B shows a side view of a load cell and driver of the low-voltage electromagnetic driving system of the second embodiment.
Figure 6A:
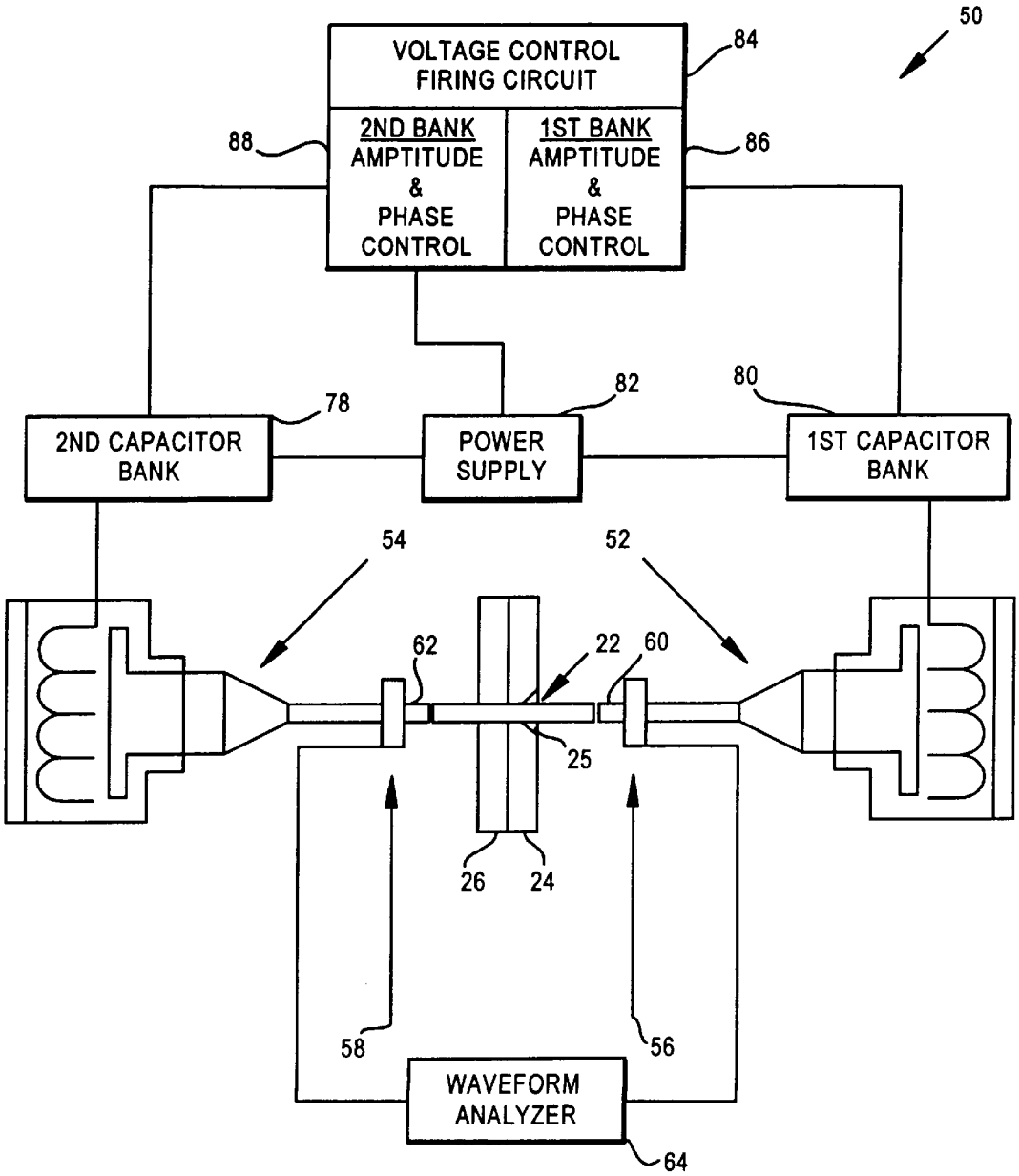
FIG. 6A shows a schematic diagram of a low-voltage electromagnetic driving system according to a second embodiment of the present invention.

In a second embodiment, the force applied to a head and a tail of a rivet is balanced, i.e applied equally over time, by controlling the rivet upsetting process using a monitoring and application assembly 50, shown in FIG. 6A.

Figure 7A:
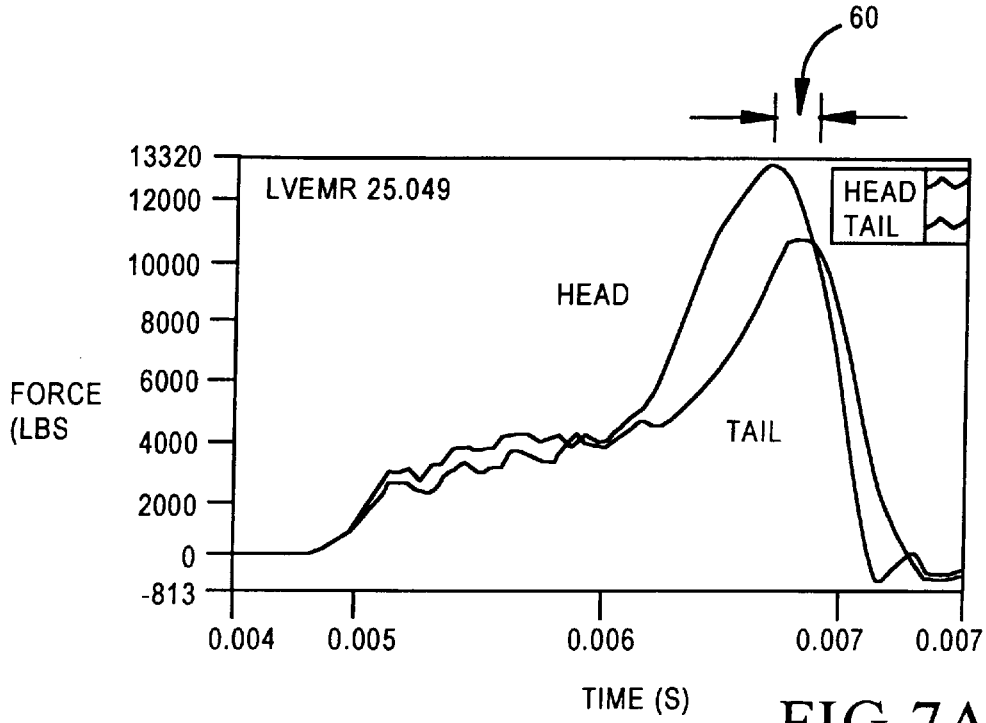
FIG. 7A shows a force vs. time graph for a rivet head and rivet tail having applied forces that are out of phase and have different magnitudes.

When riveting a workpiece that has a countersink, using two rivet guns, one at a head side and the other at a tail side of a rivet 22, the force applied to the head side is usually out of phase with and has a different magnitude than the force applied to the a tail side of the rivet 22, as shown in FIG. 7A. However, the assembly 50 can be used to create the proper differential voltage and timing so that the forces applied to the head and tail side of the rivet 22 are balanced, i.e., the forces applied over time to each side are nearly identical.

The assembly 50 includes a first load-cell 56, and a second load-cell 58, used to monitor the force applied by the electromagnetic riveter during the riveting process. Each of the first and second load-cells 56 and 58 is mounted on respective first and second drivers 52 and 54, near its respective first and second rivet die 60 and 62. Preferably, each of the first and second load-cells 56 and 58 is positioned no less than three inches from its respective first and second rivet die 60 and 62.

The first load cell 56 and the second load cell 58 are identical and are described with reference to the first load cell 56, shown in FIG. 6B. The load cell 56 includes a piezo-electric quartz cell 66, preferably a PCB Model 204M device. An integral cable 68 extends from the quartz cell 66 and is coupled to a waveform analyzer 64, such as a Nicolet Module 2580, which digitally stores the electrical waveform produced by the quartz cell 66 when a force is applied to it. By subjecting the quartz cell 66 to known forces and monitoring the output, a conversion graph can be created, where a particular electrical waveform can be converted to a force-overtime waveform.

As shown in FIG. 6B, the quartz cell 66 is coupled to the driver 56 and the head die 60, so that it will receive and register at least 95% of the force applied by the driver 56, yet dampen external noise. Two pieces of tape 70*a* and 70*b*, preferably Capton tape, are positioned on first and second sides of the quartz cell 66 that are orthogonal to a longitudinal axis of the driver 52. The two pieces of tape 70*a* and 70*b* help dampen noise produced by the driver 56, which could interfere with an accurate measurement by the quartz cell 66. First and second respective steel washers 72*a* and 72*b* are respectively positioned adjacent the Capton tapes 70*a* and 70*b*. The first and second steel washers 72*a* and 72*b*, as well as the quartz cell 66, are annular, allowing a stud 74 to pass through. The stud 74 is preferably a copper beryllium threaded stud. Copper beryllium is preferred since it may be threaded to the driver 52 and the head die 60 coupling the two physically yet allowing 95% of the force from the driver 52 to pass through the load cell 56, instead of the stud 74. Optionally, a portion 76 of the driver 52 may be threadingly detachable to allow easy maintenance and replacement of the load cell 58.

The phase and magnitude of the force applied by the first and second drivers 52 and 54 are directly caused by a "charge dump" from a respective first and second capacitor bank 78 and 80 charged by a power cell 82 and controlled by a firing circuit 84. The firing circuit has a first phase and amplitude voltage control 86 for controlling the phase and magnitude of force, via voltage, of the first driver 52, and a second phase and amplitude control 88 for controlling the phase and magnitude of force, via voltage, of the second driver 54.

There are four steps in determining the proper differential voltage and timing delay to balance the forces on the head and tail of the rivet 22. First, the desired process conditions, i.e. the desired rivet protrusion and die geometry, must be selected The forces are then monitored by the first and second load cells 56 and 58 during the rivet-forming process with no differential voltage and no timing delay, yielding a force-over-time graph as shown in FIG. 7A. The force over time applied to the rivet 22 is recorded by the waveform analyzer 64.

Figure 7B:
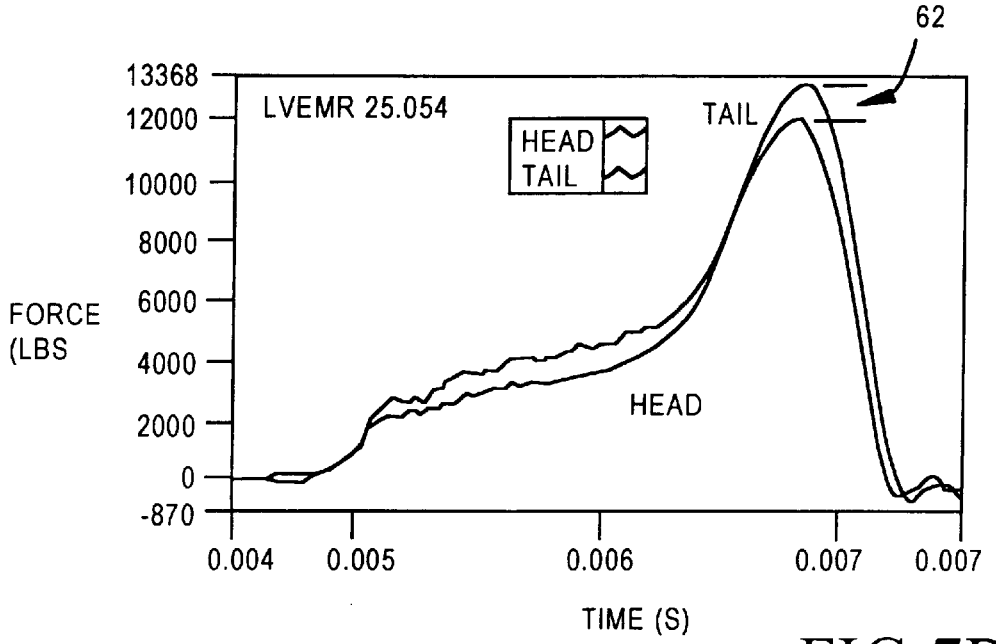
FIG. 7B shows a force vs. time graph for the rivet head and the rivet tail having applied forces that are in phase but have different magnitudes.

Next, the timing delay is adjusted to bring the forces into phase. The forces are in phase when the peak forces are reached simultaneously, as shown in FIG. 7B. It is important to adjust phase first since amplitude often changes when the phase is changed. For example, in FIG. 7A, the head force has the greatest magnitude, while in FIG. 7B, the tail force has the greatest magnitude. The proper amount of delay is approximately equal to the difference in time between the head and tail peak forces. As shown in FIG. 7A, if the phase difference 60 is 50 $\mu$s, where the head force precedes tail force, then the head force should be delayed about 50 $\mu$s by adjusting the phase using the first control 86.

Figure 7C:
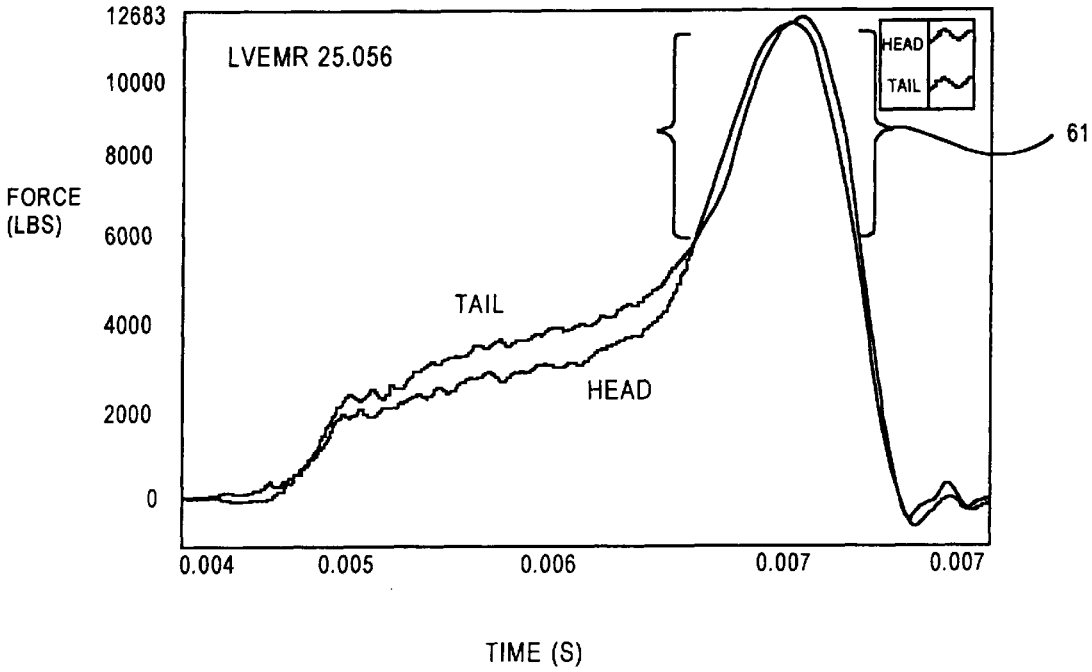
FIG. 7C shows a force v. time graph for the rivet head and the rivet tail having applied forces that are in phase and have the same peak magnitude.

For the third step, the voltages are adjusted to produce equal force magnitude, i.e. the greater force is reduced or the lesser force is increased by changing charge voltage via the firing circuit 84. In the example shown in 7B, the tail force needs to be decreased by adjusting voltage amplitude using the second control 88 until the tail force equals head force. It is most desirable if the entire force on the tail and head matches for their duration. However, if this match is not possible, it is important that the force peaks 61, i.e., the force having the greatest area, as shown in FIG. 7C, are as equal as possible. If the forces cannot be entirely aligned, then they must at least substantially match in this area.

Finally, the second and third steps are repeated until well-matched curves are achieved as in FIG. 7C.

With the present invention, it is possible to apply an equal force to a rivet head and tail, even when the head is upset into a countersink. By these arrangements, gaps between a deformed head and a countersink can be mitigated and interferences better controlled.

While the detailed description above has been expressed in terms of specific examples, those skilled in the art will appreciate that many other configurations could be used to accomplish the purpose of the disclosed inventive apparatus. Accordingly, it will be appreciated that various equivalent modifications of the above-described embodiments may be made without departing from the spirit and scope of the invention. Therefore, the invention is to be limited only by the following claims.

What is claimed is:

1. A method for mitigating gaps between a deformed head of a rivet and a countersink in an assembly that is coupled by a low-voltage electromagnetic riveter, including a head-side driver, having a first load cell, and a tail side driver, having a second load cell, and a firing control circuit capable of controlling phase and magnitude of force applied by the head-side driver and the tail-side driver, said method comprising the steps of:

(a) positioning a first test rivet within the assembly;

(b) monitoring a first output of the first load cell and the second load cell while the first test rivet is upset to determine the phase and the magnitude of the force applied to a head and a tail of the rivet respectively by the head side driver and the tail side driver;

(c) comparing the first output of the first load cell and the second load cell that occurred when the first test rivet was upset;

(d) adjusting the phase of one of the force applied by the head driver and the force applied by the tail driver so that the phase of the force applied by the head driver matches the phase of the force applied by the tail driver;

(e) positioning a second test rivet within the assembly;

(f) monitoring a second output of the first load cell and the second load cell while the second test rivet is upset to determine the phase and the magnitude of the force applied to the head and the tail of the second test rivet respectively by the head side driver and the tail side driver;

(g) comparing the second output of the first load cell and the second load cell that occurred when the second test rivet was upset; and (h) adjusting the magnitude of one of the force applied by the head driver and the force applied by the tail driver so that the magnitude of the force applied by the tail driver equals the magnitude of the force applied by the head driver.

2. The method according to claim 1 further including the step of repeating steps (a) through (h) until the first and second driver have a phase and a magnitude over time that are substantially equal.

3. The method according to claim 1 further including the step of repeating steps (a) through (h), until at least at a peak area of force over time is reached, the first and second driver have a phase and a magnitude that are substantially equal.

* * * * *